US009011190B2

(12) United States Patent
Hanstrom

(10) Patent No.: US 9,011,190 B2
(45) Date of Patent: Apr. 21, 2015

(54) APPARATUS AND METHOD FOR BOAT MOTOR WINTERIZING

(71) Applicant: Scott Hanstrom, Dallas, TX (US)

(72) Inventor: Scott Hanstrom, Dallas, TX (US)

( * ) Notice: Subject to any disclaimer, the term of this patent is extended or adjusted under 35 U.S.C. 154(b) by 145 days.

(21) Appl. No.: 13/725,417

(22) Filed: Dec. 21, 2012

(65) Prior Publication Data

US 2014/0179180 A1 Jun. 26, 2014

(51) Int. Cl.

| | |
|---|---|
| ***B63H 21/38*** | (2006.01) |
| ***F01P 3/20*** | (2006.01) |
| ***B63H 20/28*** | (2006.01) |
| ***B63H 20/30*** | (2006.01) |
| *F01P 11/06* | (2006.01) |

(52) U.S. Cl.

CPC ..... *B63H 21/383* (2013.01); *F01P 3/202* (2013.01); *F01P 2011/068* (2013.01); *B63H 20/285* (2013.01); *B63H 20/30* (2013.01)

(58) Field of Classification Search

USPC ..... 440/88 R

IPC ..... F01P 3/202

See application file for complete search history.

(56) References Cited

U.S. PATENT DOCUMENTS

| | | | | |
|---|---|---|---|---|
| 5,823,836 | A * | 10/1998 | Anderson | 440/88 R |
| 5,902,159 | A | 5/1999 | Killpack et al. | |
| 6,165,033 | A | 12/2000 | Cugini | |
| 6,206,740 | B1 * | 3/2001 | Sholler | 440/88 R |
| 6,510,862 | B2 | 1/2003 | Prentice | |
| 6,579,136 | B1 | 6/2003 | Hahn et al. | |
| 6,769,943 | B1 | 8/2004 | Abell | |
| 7,309,266 | B2 | 12/2007 | Botsaris et al. | |
| 7,438,613 | B2 | 10/2008 | Hubbs | |
| 2005/0126630 | A1 | 6/2005 | Swan | |

OTHER PUBLICATIONS

How to use the Winterflush product, www.winterflush/insructions.com, printed from the Internet Jul. 26, 2011.

* cited by examiner

*Primary Examiner* — Stephen Avila

(74) *Attorney, Agent, or Firm* — Vincent J. Allen; Carstens & Cahoon, LLP

(57) ABSTRACT

There is provided a portable (easily carried by one person), re-usable apparatus for protecting an engine of a watercraft by filling engine passageways with a protective fluid. The apparatus does not require a pump for the protective fluid. In operation, filling the container with protective fluid, clamping the flexible cup to the water intake ports, and opening the valve permits the running engine of the watercraft to suction protective fluid into cooling fluid passageways within the engine. The entire operation is carried out without a pump to pressurize the protective fluid, and minimizes fluid safe disposal requirements.

11 Claims, 3 Drawing Sheets

APPARATUS AND METHOD FOR BOAT MOTOR WINTERIZING

BACKGROUND

1. Field of the Invention

The invention relates to the protection of motors, especially but not limited to motors for watercraft, to allow safe storage under conditions, such as cold weather conditions. More particularly, the invention provides ecologically-friendly apparatus and methods for displacing water from cooling passageways within a motor with a protective material while minimizing requirements for waste fluid disposal.

2. Description of the Related Art

The seasonal use of motorized watercraft, including boats, and water-recreational vehicles, such as Sea-Doos™, for example, has often raised the issue of maintenance during the cold weather season when these craft are typically not in use. During this season, the cold surrounding environment poses a significant risk that water within serpentine cooling channels within the boat engine (or "motor") may freeze. The freezing of water results in expansion and stress on the cooling channels that may result in engine damage. The damage may be so severe as to require replacement of the engine.

U.S. Pat. No. 7,309,266 relates to a winterizing system for personal watercraft that includes a pressurized container. The assembled system is illustrated in FIG. 1, and the tank shown is pressurized to about 30 to 50 psi. Accordingly, an appropriate pressure rated tank is necessary. The system requires a pressure regulator and a stop valve; and it is recommended that the stop valve remain closed until the engine has been turned on to avoid engine damage.

U.S. Pat. No. 6,579,136 also relates to engine winterizing systems for inboard marine engines, and has a simple system that is illustrated in FIG. 1. The system includes a reservoir for holding a protective fluid (anti-freeze), a dispenser, such as a valve, and a connector to couple to a raw water passageway of a marine engine at a specific location, downstream of the raw water intake port.

U.S. Pat. No. 6,165,033 relates to an anti-freeze circulating device for use in winterizing an outboard motor that of a watercraft that is not in the water. The device includes a catch basin (or "trough") that may be located beneath the engine to facilitate catching fluid displaced from the engine. A pump takes suction from the catch basin filled with anti-freeze, and pumps the anti-freeze through a hose to a clamping device having a flexible cup at its ends. The flexible cups fit over the engine water intakes so that when the engine is started and is running, anti-freeze is pumped (under pressure from the pump) via the flexible-cup-covered water intakes, through the cooling passageways in the engine, displacing water therein, and expelling the water into the catch basin. The system clearly has both complications and disadvantages: the pump must be selected to supply enough anti-freeze so that the motor does not overheat, resulting in damage. Moreover, the pump should not supply so high a pressure as to cause damage. Further, as water is displaced from the engine to the catch basin, it dilutes the anti-freeze in the catch basin, which is used to winterize the engine. Therefore, an excess of anti-freeze must be used to avoid too much dilution, resulting in inadequate protection during cold weather conditions. The disposal of the relatively high volume of diluted anti-freeze in the catch basin may pose environmental concerns, and the apparent necessity to use an excess amount may add to disposal costs.

SUMMARY

Exemplary embodiments of the invention provide several advantages in winterizing or otherwise treating the engines of watercraft, in particular outboard motors. The apparatus is easy to use, and can be carried, set up and operated by a single person without assistance from another. In addition, the apparatus does not include, and does not need, a pump for the engine-protective fluid. The apparatus is relatively inexpensive and can be re-used year-after-year. In accordance with the apparatus and methods, the amount of protective fluid needed is less than might be used in other methods. Because the protective fluid is not mingled with water displaced from the engine, and is not diluted, as for example in U.S. Pat. No. 6,165,033, a lower volume of protective fluid is needed. As a result, there is a reduction in the amount of fluid that may have to be disposed of in an ecologically sound manner.

An exemplary embodiment of a portable, re-usable apparatus for winterizing an engine of a watercraft, while the watercraft is out of the water includes several components, but does not include or require a pump for the protective fluid. The apparatus includes a container for receiving a quantity of protective fluid for the engine of the watercraft. The container has a vent proximate a first end of the container and a fluid port at an opposite end of the container. A hose has a first end coupled to the fluid port of the container and is in fluid communication with an interior of the container. A valve controls flow of fluid from the container to the hose. In addition, the kit includes a flexible cup having a port coupled to a second end of the hose, the flexible cup sized to cover water intake ports of the watercraft. The kit has a clamp configured to hold the flexible cup over the water intake ports, until the engine of the watercraft is running and suction forces of the water intake maintain the flexible cup in position. In operation, filling the container with protective fluid, clamping the flexible cup to the water intake ports, and opening the valve permits the running engine of the watercraft to suction protective fluid into cooling fluid passageways within the engine. The protective fluid displaces water from the passageways through an exit port of the engine. Significantly, the entire winterizing operation is carried out without a pump to pressurize the protective fluid. This removes the need for a nearby electrical outlet to power a pump, and avoids the cost of buying a pump.

In another exemplary embodiment, the clamp, referenced above, is configured to hold the flexible cup over the water intake ports of the engine of the watercraft, until the engine is running and suction forces of the water intake maintain the flexible cup in position. The clamp has a U-shape having a pair of legs connected by a curved portion. A flexible cup is located proximate an end of each leg of the U-shape. At least one flexible cup has a convex side coupled to the second end of the hose and has a through hole for fluid to flow from the hose through the flexible cup to a concave side of the flexible cup. The legs of the U-shape may have a spring-like resilience to receive and resiliently clamp the watercraft intake ports releasably between them.

Another exemplary embodiment provides a method of using a portable re-usable apparatus for winterizing an engine of a watercraft, while the watercraft is out of the water. The apparatus has no pump. The method includes the steps of filling a container with a protective fluid; connecting a first end of a hose to the container; connecting a second end of the hose to a flexible cup; and placing the flexible cup over water intake ports of the engine of the watercraft. In addition the method includes running the engine; and opening a valve to allow protective fluid to flow, under suction from the engine, from the container through the flexible cup, to the water intake ports, into passageways within the engine. This is continued until shutting off the engine, when the container has emptied, or the desired filling of the passageways of the engine with protective fluid has been achieved. If the container empties before the passageways are substantially filled, then the container may be refilled with a volume of fluid as necessary, and the appropriate steps of the operation recommenced.

BRIEF DESCRIPTION OF THE DRAWINGS

The foregoing aspects and many of the attendant advantages, of the present technology will become more readily appreciated by reference to the following Detailed Description, when taken in conjunction with the accompanying simplified drawings of exemplary embodiments. The drawings, briefly described here below, are not to scale, and scale may be deliberately distorted to better present important features. The drawings are presented for ease of explanation and do not limit the scope of the inventions recited in the accompanying patent claims.

DETAILED DESCRIPTION

Exemplary embodiments of the invention provide several advantages in winterizing or otherwise treating the engines of watercraft, in particular outboard motors. The apparatus is easy to use, and can be carried, set up and operated by a single person without assistance from another. In addition, the apparatus does not include, and does not need, a pump for the engine-protective fluid. The apparatus need only be elevated so as to facilitate siphoning protective fluid, under gravity and suction from the engine water intake ports, into the cooling water passageways of the engine. The apparatus is relatively inexpensive and robust, lacking any "moving parts" and can be re-used year-after-year.

The apparatus and methods of the invention are more environmentally friendly than other methods because the volume of protective fluid needed is less than might be used in other methods, and because there is less waste fluid (and fluid-water mixture) that must be disposed of safely. Because the protective fluid is not mingled with water displaced from the engine, and is therefore not diluted, as for example in U.S. Pat. No. 6,165,033, less protective fluid is needed at the outset to fill the engine passageways with fluid of a sufficiently high concentration. As a result, there is a reduction in the amount of fluid used to fill the engine passageways. In addition, because there is no waste, such as a mixture of protective fluid and water displaced from the engine passageways, the technology is more ecologically sound.

The following non-limiting detailed descriptions of examples of embodiments of the invention may refer to appended Figure drawings and are not limited to the drawings, which are merely presented for enhancing explanations of features of the technology. In addition, the detailed descriptions may refer to particular terms of art, some of which are defined herein, as appropriate and necessary for clarity.

The following detailed description uses the term "motor" or "engine" interchangeably to refer to the internal combustion engines that are used in watercraft, and include both inboard and outboard motors that may benefit from the inventions.

The term "watercraft" refers to boats of all kinds, and also other water-borne vehicles or devices that have engines with internal passageways that require treatment with a protective fluid, such as an anti-freeze formulation, from time to time.

Figure 1:
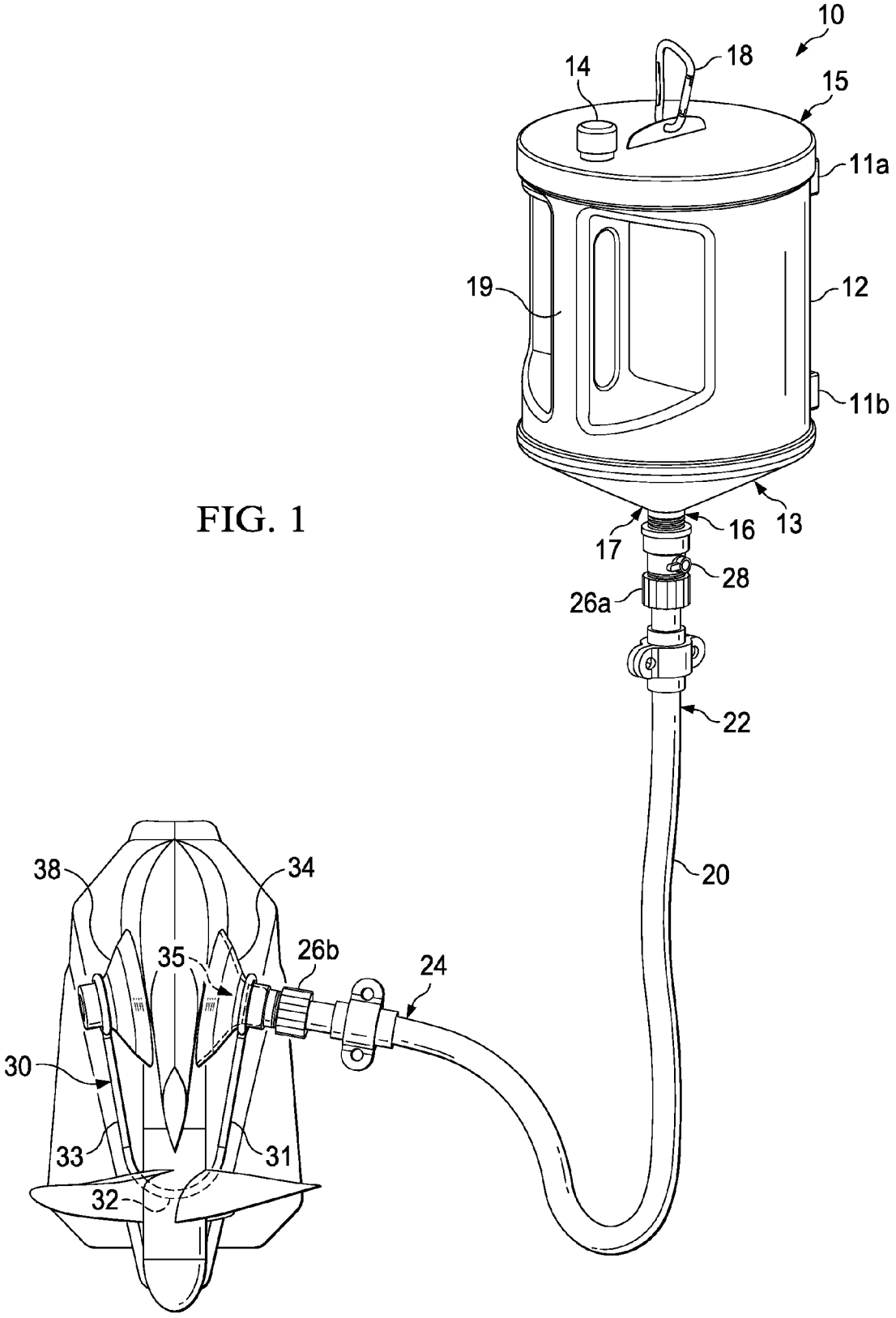
FIG. 1 is a schematic illustration of an exemplary, non-limiting, assembled embodiment of a portable, re-usable, environmentally-friendly winterizing kit in accordance with the invention, attached to a watercraft, depicted in end view.
Figure 2:
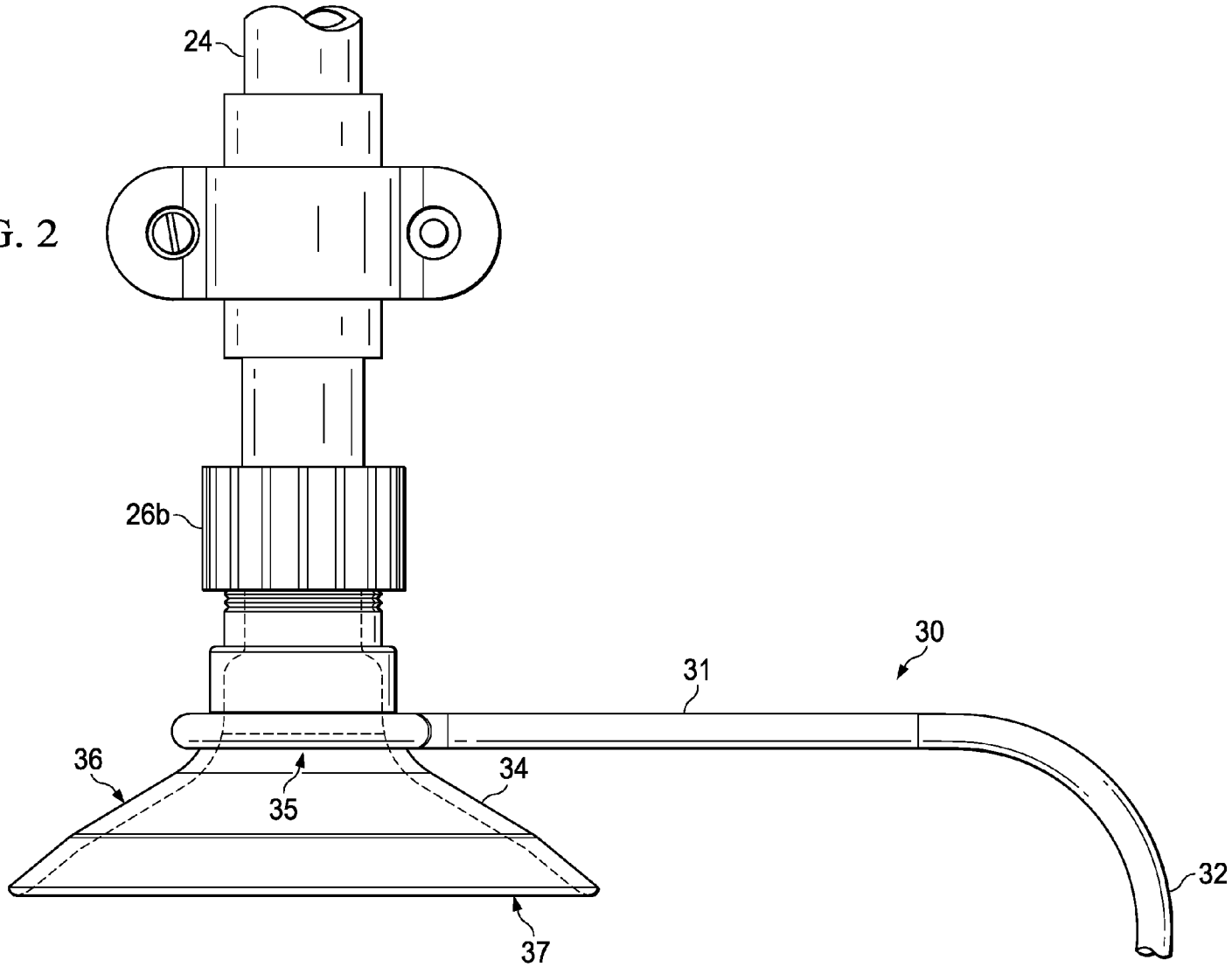
FIG. 2 is a schematic illustration of a portion of an exemplary, non-limiting, embodiment of a flexible cup clamp used in combination in accordance with the invention.
Figure 3:
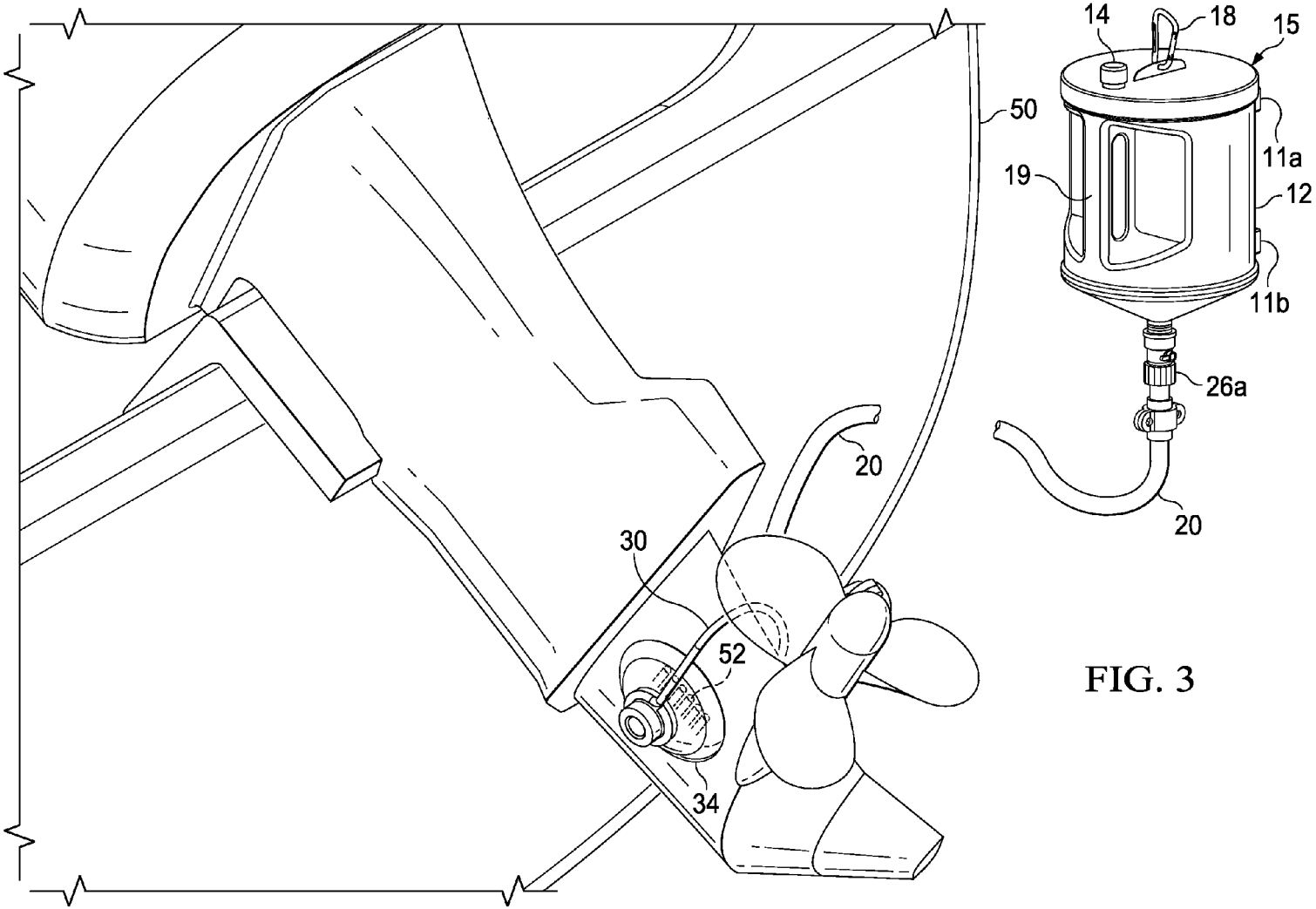
FIG. 3 is a schematic illustration of an exemplary, non-limiting, assembled embodiment of a portable, re-usable, environmentally-friendly winterizing kit in accordance with the invention, attached to an outboard motor of a water craft that is out of the water.

An exemplary assembled embodiment, illustrated in FIG. 1, provides a portable, re-usable apparatus 10 for winterizing an engine of a watercraft, while the watercraft is out of the water, or at least while the water intake ports are above the water line and exposed for access. The apparatus 10 includes several components, but does not include or require a pump for the protective fluid. This is a significant advantage in that it avoids the expense of purchasing a pump, and also the inconvenience of having to be near an electrical outlet (or use the watercraft's battery) to power the pump. The apparatus 10, which may be sold as a kit including all necessary parts, includes a container 12 for receiving a quantity of protective fluid for the engine of the watercraft. The container 12 has a vent 14 proximate a first end 15 of the container 12 and a fluid port 16 at an opposite end 17 of the container 12. A hose 20 has a first end 22 coupled by connector 26*a* to the fluid port 16 of the container 12 and is in fluid communication with an interior of the container 12. A valve 28 controls flow of fluid from the container to the hose 20. In addition, the kit 10 includes a flexible cup 34, for example, such as a suction cup having a convex side and a concave side. The flexible cup has a through hole 35 coupled to a second end 24 of the hose 20. The flexible cup 34 is sized to cover the water intake ports 52 (see FIG. 3) of the watercraft 50. The kit 10 has a clamp 30 configured to hold the flexible cup over the water intake ports, until the engine of the watercraft is running and suction forces of the water intake maintain the flexible cup 34 in position. As shown more clearly in the exemplary embodiment illustrated in FIG. 2, the clamp 30 has a U-shape, having a pair of legs 31, 33 connected by a curved portion 32, a flexible cup 34, 38 is located proximate an end of each leg 31, 33 of the U-shape. At least one of the flexible cups 34 has a convex side 36 coupled to the second end 24 of the hose 20 by connector 26*b*. Flexible cup 34 has a through hole 35 for fluid to flow from the hose through the flexible cup 34 from the convex side 36 to the concave side 37 of the flexible cup. The legs 31, 33 of the U-shape are spring-like in resilience so that they receive and resiliently clamp the watercraft intake ports releasably between them.

In operation, filling the container 12 with protective fluid, clamping the flexible cup 34 to the water intake ports, and opening the valve 28 permits the running engine of the watercraft to suction protective fluid into cooling fluid passageways within the engine. The protective fluid displaces water from the passageways through an exit port of the engine.

The container may optionally include a hook 18 (FIG. 1) that is sized and configured to attach to an attachment point (not shown) of the watercraft 50 (FIG. 3), such as an attachment point for a water skier to be pulled behind the watercraft. The container 12 may be suspended by the hook 18 so as to hold the container 12 at an elevation above the water intake ports 52 (FIG. 3) to facilitate suctioning of fluid from the container 12 into the water intake ports of the watercraft.

The container 12 may optionally have a handle 19, to facilitate carrying the filled container. In addition, a pair of transverse flats 11*a*, 11*b* may be formed with the container so that the container may be set down in a stable and horizontal position, for example on an elevated platform of the watercraft, or back of a pickup truck that is above the water intake ports 52 of the watercraft. Preferably, the handle 19 and flats 11*a*, 11*b* may be molded along with the container as a single piece.

The container 12 may be sized to hold sufficient fluid for a single fill to substantially completely fill the passageways of the engine. However, if the portability of the container is affected to the point that one person cannot by himself fill and lift the filled container to carry out the method of winterizing, then a container sized for ease of use may be used. This would require more than one full container to carry out the winterizing process. The container 12 may be uncoupled from the hose 20 and re-filled to continue the process. In an exemplary embodiment, the container holds from 1.5 to 2.5 US gallons of protective fluid, although it can be smaller or larger.

The illustrated exemplary embodiment of a container 12 is substantially cylindrical in shape with a conical end portion 13 that facilitates draining of fluid from the container. The fluid port 16 is at or proximate an apex of the conical portion 13. Of course, other shapes of container may also be used.

In an exemplary embodiment, the container 12, valve 28, hose 20 and flexible cup 34 are comprised of materials substantially impervious to attack by anti-freeze fluids. Such materials are desirably light weight to facilitate portability, and inexpensive as well. Plastics of several kinds are known to be impervious to anti-freeze materials, and may be used, bearing in mind that long term resistance to chemical exposure is not essential because the apparatus will be low cost, used only once a year, and can be rinsed after each use.

In an exemplary method of using a portable re-usable apparatus for winterizing or otherwise treating an engine of a watercraft, the treatment is performed while the watercraft is out of the water, or at least has its water intake ports exposed above the water line for access. The method includes standing the container 12 upright with conical end 17 up, and filling the container with the desired protective fluid. A first end of the hose 20 is then connected to the container 12, for example, by using a connector that threads to port 16 and to hose end 22. The other end of the hose is then (or beforehand) connected to the flexible cup 34, for example, by a threaded connector. All connections should be "water tight" to avoid leaks. The clamp 30 is then slidingly engaged with a portion on the motor faring that has the water intake ports for the engine. The clamp 30 is positioned, as exemplified in FIG. 3, such that the flexible cup 34 is located to cover the water intake ports of the engine of the watercraft. The vent 14 of container 12 is opened, and the engine of the watercraft is then turned on so that the engine runs. Opening the valve 28 of the apparatus allows protective fluid to flow, under gravity and suction pressure from the engine, from the container through the hose and flexible cup, to the water intake ports, and into passageways within the engine. This is continued until either the passageways are filled, or until the fluid in the container is exhausted. Then the engine is shut off. If the passageways are not substantially filled with protective fluid, then more protective fluid is added to the container, in any convenient manner. For example, it might be useful to add fluid via the top vent using a funnel, or the container may be disconnected from the hose and filled through fluid port 16. Appropriate steps detailed above are then repeated until the passageways of the engine are substantially filled with protective fluid.

During the operation, the container may be suspended by the hook 18 at an elevation that is above the water intake ports 52 of the watercraft to facilitate gravity-assisted flow of fluid into the engine passageways. In addition, water and any small amounts of protective fluid ejected from the engine may be collected and disposed of safely. Environmentally acceptable anti-freeze such as that sold under the mark, "Ice Clear"® HD, of Orison Marketing LLC of Abilene, Tex., meeting ASTM D7714 and D7715 standards, may also be used with the present technology to further reduce any environmental concerns.

The methods are carried out without a pump or any need for pumping of the protective fluid. Fluid flows under gravity from the container, and under such suction pressure as may be produced at the water intake ports of the watercraft, into the engine passageways. Accordingly, the container and the entire apparatus 10 need not be pressure rated, as is the case of some other apparatus.

While examples of embodiments of the technology have been presented and described in text and some examples also by way of illustration, it will be appreciated that various changes and modifications may be made in the described technology without departing from the scope of the inventions, which are set forth in and only limited by the scope of the appended patent claims, as properly interpreted and construed.

The invention claimed is:

1. A portable, re-usable apparatus for winterizing an engine of a watercraft, while the watercraft is out of the water, the apparatus comprising a kit having no pump, the kit comprising:

a container for receiving therein a quantity of protective fluid for the engine of the watercraft, the container having a fluid port at an end thereof, the container comprising a conical end portion, and the fluid port is at or proximate an apex of the conical portion; the container comprising a hook, the hook attached centrally an end opposite to the conical end portion and configured for attachment to an attachment point to hold the container at an elevation above water intake ports of an engine of the watercraft, the container sized to hold sufficient protective fluid to fill passageways in communication with water intake and water exit ports of the engine of the watercraft;

a hose having a first end coupled to the fluid port of the container and in fluid communication with an interior of the container;

a valve for controlling flow of fluid from the container to the hose;

a flexible cup having a port coupled to a second end of the hose, the flexible cup sized to cover water intake ports of the watercraft; and a clamp configured to hold the flexible cup over a water intake port, until the engine of the watercraft is running and suction forces of the water intake maintain the flexible cup in position;

wherein filling the container with protective fluid, clamping the flexible cup to the water intake ports, and opening the valve permits a running engine of the watercraft to suction protective fluid into cooling fluid passageways within the engine and displace water from the passageways through an exit port of the engine, without a pump to pressurize the protective fluid.

2. The portable apparatus of claim 1, wherein the container, valve, hose and flexible cup are comprised of materials substantially impervious to attack by anti-freeze fluids.

3. The portable apparatus of claim 1, wherein the clamp comprises a U-shape having a pair of legs connected by a curved portion, a flexible cup located proximate an end of each leg of the U-shape, at least one flexible cup having a convex side coupled to the second end of the hose, said flexible cup having a through hole for fluid to flow from the hose through the flexible cup to a concave side of the flexible cup, the legs of the U-shape having spring-like resilience to receive and resiliently clamp the watercraft intake ports releasably between them.

4. The portable apparatus of claim 1, wherein the watercraft comprises an outboard motor.

5. A portable, re-usable apparatus for winterizing an engine of a watercraft, while the watercraft is out of the water, the apparatus comprising a kit having no pump, the kit comprising:

a container for receiving therein a quantity of protective fluid for the engine of the watercraft, the container having a fluid port at an end thereof, the container comprising a conical end portion, and the fluid port is at or proximate an apex of the conical portion; the container comprising a hook, the hook attached centrally an end opposite to the conical end portion and configured for attachment to an attachment point to hold the container at an elevation above water intake ports of an engine of the watercraft, the container sized to hold sufficient protective fluid to fill passageways in communication with water intake and water exit ports of the engine of the watercraft;

a hose having a first end coupled to the fluid port of the container and in fluid communication with an interior of the container;

a valve controlling flow of fluid through the hose;

at least one flexible-cup having a port coupled to a second end of the hose, the flexible cup sized to cover water intake ports of the watercraft, the flexible cup having a through hole permitting fluid communication from the hose through a convex side of the flexible cup to a concave side of the flexible cup; and a clamp configured to hold the flexible cup over the water intake ports, until the engine of the watercraft is running and suction forces of the water intake maintain the flexible cup in position; the clamp comprising a U-shape having a pair of legs connected by a curved portion, a flexible cup located proximate an end of each leg of the U-shape, at least one flexible cup having a convex side coupled to the second end of the hose, said flexible cup having a through hole for fluid to flow from the hose through the flexible cup to a concave side of the flexible cup, the legs of the U-shape having spring-like resilience to receive and resiliently clamp the watercraft intake ports releasably between them;

wherein filling the container with protective fluid, clamping the flexible cup to the water intake ports, and opening the valve permits a running engine of the watercraft to suction protective fluid into cooling fluid passageways within the engine and displace water from the passageways through an exit port of the engine, without a pump to pressurize the protective fluid.

6. The portable apparatus of claim 5, wherein the container, valve, hose and flexible cup are comprised of materials substantially impervious to attack by anti-freeze fluids.

7. The portable apparatus of claim 5, wherein the watercraft comprises an outboard motor.

8. A method of using a portable re-usable apparatus for winterizing an engine of a watercraft, while the watercraft is out of the water, the apparatus having no pump, the method comprising:

filling a container with a protective fluid comprising anti-freeze;

connecting a first end of a hose to the container;

connecting a second end of the hose to a flexible cup;

placing the flexible cup over water intake ports of the engine of the watercraft running the engine;

opening a valve to allow protective fluid to flow under suction from the engine from the container through the flexible cup, to the water intake ports, into passageways within the engine;

at least partially filling the passageways of the engine with protective fluid;

collecting water and protective fluid expelled from the engine passageways for safe disposal; and shutting off the engine before the passageways are substantially filled with protective fluid;

adding more protective fluid to the container; and repeating steps of the method until the passageways of the engine are substantially filled with protective fluid.

9. The method of claim 8, further comprising suspending the container filled with protective fluid at an elevation above the water intake ports of the engine.

10. The method of claim 8, further comprising clamping the flexible cup in position over the water intake ports of the engine.

11. The method of claim 8, wherein the engine comprises an outboard motor.

* * * * *